United States Patent [19]

Hirooka et al.

[11] Patent Number: 4,843,671

[45] Date of Patent: Jul. 4, 1989

[54] DEHYDRATING METHOD FOR A WASHING MACHINE

[75] Inventors: Hiroshi Hirooka; Takeshi Saito; Hirobumi Urabe, all of Chiba, Japan

[73] Assignees: Mitsubishi Denki Kabushiki Kaisha, Tokyo, Japan; Nihon Kentetsu Co., Ltd.

[21] Appl. No.: 826,653

[22] Filed: Feb. 6, 1986

[30] Foreign Application Priority Data

| | | | |
|---|---|---|---|
| Feb. 6, 1985 | [JP] | Japan | 60-21182 |
| Nov. 22, 1985 | [JP] | Japan | 60-262932 |
| Nov. 22, 1985 | [JP] | Japan | 60-262933 |

[51] Int. Cl.[4] ..... D06F 33/02

[52] U.S. Cl. ..... 8/159; 68/12 R; 68/23 R

[58] Field of Search ..... 8/159, 158; 68/23 R, 68/12 R, 23.1, 23.3, 24

[56] References Cited

U.S. PATENT DOCUMENTS

| | | | |
|---|---|---|---|
| 2,950,613 | 8/1960 | Bochan | 68/23.1 X |
| 3,003,090 | 10/1961 | Neyhouse et al. | 68/24 X |
| 3,311,237 | 3/1967 | Bergeson et al. | 68/23.1 X |
| 3,321,941 | 5/1967 | Ellis | 68/23.1 |
| 3,640,098 | 2/1972 | Eastall | 68/12 R |
| 4,329,858 | 5/1982 | Okazaki | 68/12 R |
| 4,513,464 | 4/1985 | Rettich et al. | 8/159 |
| 4,517,695 | 5/1985 | Hoffmann et al. | 8/158 |
| 4,607,408 | 8/1986 | Didier et al. | 8/159 |
| 4,631,771 | 12/1986 | Anderson et al. | 8/159 X |

FOREIGN PATENT DOCUMENTS

| | | |
|---|---|---|
| 0071308 | 9/1983 | European Pat. Off. . |
| 718863 | 11/1954 | United Kingdom . |
| 836340 | 5/1961 | United Kingdom . |
| 1255470 | 5/1969 | United Kingdom . |
| 1211330 | 11/1970 | United Kingdom . |
| 1563876 | 4/1980 | United Kingdom . |
| 2087103 | 5/1982 | United Kingdom . |

*Primary Examiner*—Philip R. Coe

*Attorney, Agent, or Firm*—Sughrue, Mion, Zinn, Macpeak & Seas

[57] ABSTRACT

In the initial stage of the dehydrating operation (spin cycle) in a washing machine, operations of rotating the dehydrating tank at a low speed for a predetermined period of time or of stopping the driving motor temporarily when the speed of rotation of the dehydrating tank reaches a predetermined low value are repeated a plurality of times. During this operation, the water contained in the clothes in the dehydrating tank is partly removed and the weight of the load decreased as much. Therefore, in a dehydrating operation in which the tank is rotated at a high speed, the clothes do not have a strong tendency to shift to one side, with the result that little vibration and noise are produced.

7 Claims, 8 Drawing Sheets

DEHYDRATING METHOD FOR A WASHING MACHINE

BACKGROUND OF THE INVENTION

The present invention relates to operation control methods for washing machines, and more particularly to a dehydrating method (spin-cycle control method) for washing machines.

The basic construction of a washing machine of the type to which the invention pertains will be described with reference to FIG. 1, which is a sectional side view of the washing machine. The washing machine shown is of the fully automatic, single-tank agitation type. In FIG. 1, reference numeral 1 designates an agitator composed of a hollow cylinder in which are formed a number of through-holes 2 and which has several agitator blades 3 secured to the outer wall of the cylinder extending vertically and arranged radially, and reference numeral 4 designates a dehydrating (spin) tank having the agitator 1 at its center. Through-holes 5 are formed in the side wall of the dehydrating tank 4. A balancer 6 including a hollow annular member is formed at the upper end opening of the dehydrating tank 4. The balancer 6 is used to prevent vibration of the dehydrating tank during dehydration. Further in FIG. 1, reference numeral 7 designates a water receiving tank provided outside the dehydrating tank 4, the tank 7 having a water discharging outlet (not shown) to which a drain pipe (not shown) is connected.

In FIG. 1, reference numeral 8 designates an electric motor which is coupled to a rotation transmitting section 12 through a speed reducing mechanism including a pulley 9, an endless V-belt 10, and a pulley 11. The rotation transmitting section has dual drive shafts **12*a* and 12*b* which are controlled by a spring clutch mechanism 13. The outer drive shaft 12*a* is coupled to the dehydrating tank 4, and the inner drive shaft 12*b* to the agitator 1**.

The above-described mechanisms are all installed through a vibration preventing buffer (not shown) in the outer casing (not shown). A control device using a microcomputer and an operating section including operating switches are provided on the upper part of the outer casing. The outputs of a water level detector and other detectors are applied to the control device. The outputs of the control device are applied to a drive circuit for the motor 8, a valve control circuit for a water supplying valve, a water discharging valve, and other circuits.

In washing, rinsing and dehydrating operations with the washing machine, the clothes to be washed (the load), water and detergent are put in the tank 4, and then the power switch is turned on. As a result, the motor 8 is rotated alternately in the forward direction and in the reverse direction, and accordingly the agitator is rocked to effect washing. As controlled by a timer in the control device, the washing operation is continued for a predetermined period of time, whereupon the water is discharged. Thus, the washing cycle has been accomplished, and the dehydrating (spin) cycle is carried out.

In the dehydrating cycle, the spring clutch mechanism 13 is operated to rotate the shaft **12*b* together with the shaft 12*a*. The motor 8 is rotated in one direction only so that the dehydrating tank 4 is rotated through the pulley 9, the V-belt 10, the pulley 11, and the rotation transmitting section 12 by the motor 8. In this case, the speed of rotation of the dehydrating tank 4 is determined by the speed reduction ratio of the pulleys 9 and 11, and the speed of rotation of the motor 8** is determined from the number of poles. In the case of an induction motor, the steady-state speed of rotation is 900 rpm. When the speed of rotation reaches this value, the dehydrating operation is started.

In the above-described conventional dehydrating method, the rotation of the dehydrating tank is such that immediately after the rotation of the dehydrating tank is started, the speed of rotation of the tank quickly reaches a high speed of rotation of 900 rpm. Therefore, a high centrifugal force is abruptly applied to the wet clothes in the tank 4, which tends to shift the latter to one side of the tank 4, as a result of which the dehydrating tank strongly vibrates and produce large amounts of noise. Such vibration cannot be completely absorbed by the balancer 6 provided at the upper end opening of the tank 4.

The dehydrating tank 4 may be intermittently rotated merely by controlling the period of energization of the motor 8. However, since the force of rotation due to inertia depends on the weight of the load (the wet clothes), it is impossible to achieve accurate speed control with this method.

On the other hand, the dehydrating tank of a fully automatic washing machine in which the dehydrating tank is used as the washing tank also is larger than that of a double-tank type washing machine in which a washing tank is provided separately from the dehydrating tank. Therefore, the noise output and vibration of the former are generally larger than of the latter. In order to minimize the amount of noise and vibration, a balancer for causing the dehydrating tank to rotate in a horizontal plane is provided at the upper end opening of the dehydrating tank; however, a balancer cannot sufficiently eliminate the production of noise and vibration.

Recently, thin fabrics and delicate fibers such as wool are often washed in a home washing machine. In the conventional dehydrating operation, only one speed of rotation, which is considerably high (900 rpm), is provided. If woolen clothes are washed in such a machine and dried in a dehydrating tank which is rotated at such a high speed, an excessively high centrifugal force tends to be applied. As a result, the clothes can be excessively dehydrated and damaged or creased. This difficulty cannot be eliminated even if the period of dehydration is decreased or the dehydrating tank is intermittently rotated utilizing a timer.

SUMMARY OF THE INVENTION

An object of this invention is to provide a dehydrating method for a washing machine by which the above-described difficulty is eliminated, that is, with which, during the dehydrating operation, the shifting of the load to one side of the dehydrating tank is prevented, and production of large amounts of noise and vibration is prevented.

In order to achieve the foregoing object of the invention, in a dehydrating method for a washing machine according to the invention, in the initial stage of the dehydrating operation, the dehydrating tank is first rotated at a low speed and for a predetermined period of time only then rotated at a low speed.

More specifically, according to the invention, in the initial stage of the dehydrating operation, the dehydrating tank is rotated at a low speed for the predetermined period of time, the low speed being below the resonance point at which the tank vibrates strongly. During this period, the water in the clothes is partially removed, and hence the weight thereof is accordingly decreased. Therefore, in the following dehydrating operation during high speed rotation, less of an eccentric load is applied to the dehydrating tank, and accordingly little noise and vibration are produced.

Further in order to achieve the foregoing object, in a second embodiment of the invention, speed detecting means is provided, and the output of the speed detecting means is that utilized so that, in the initial stage of the dehydrating operation, when the speed of rotation of the hydrating tank reaches a predetermined low speed of rotation, the electric motor is temporarily stopped, and this operation is repeated a plurality of times.

According to this embodiment of the invention, in the initial period of the dehydrating operation, the dehydrating tank is rotated intermittently at a low speed whose upper limit is lower than the resonance point at which the dehydrating tank vibrates maximally. Therefore, the speed of rotation of the dehydrating tank never becomes higher than the resonance point, and the dehydrating tank never vibrates strongly. During the dehydrating operation, the water in the clothes in the tank is removed partially, and the weight of the load is thereby decreased as much. Accordingly, during the subsequent high speed rotation of the dehydrating tank to fully remove the water from the clothes, the eccentric load is less and vibration is scarcely caused.

Another object of the invention is to provide a dehydrating method for a washing machine by which not only strong fabrics such as cottons, but also more delicate fabrics such as woolens can be dehydrated without damage or creasing.

In order to achieve the second object of the invention, in a dehydrating method for a washing machine according to the invention, frequency conversion means is connected to an electric motor for the dehydrating tank, and outputs of the frequency conversion means are utilized to control the dehydrating operation at a high speed of rotation or at a speed of rotation which is of the order of one-third to one-half the ordinary high speed of rotation.

According to a third embodiment of the invention, before the start of a washing operation, an input is applied to the frequency conversion means to indicate the kinds of fabric forming the load, and outputs of the frequency conversion means are utilized to perform the dehydrating operation at a high speed of rotation or at a low speed of rotation as appropriate. Therefore, a centrifugal force suitable for the specific load is obtained, and hence the clothes will never be damaged by the dehydrating operation.

DESCRIPTION OF THE PREFERRED EMBODIMENTS

Preferred embodiments of the invention will be described with reference to the accompanying drawings.

Figure 1:
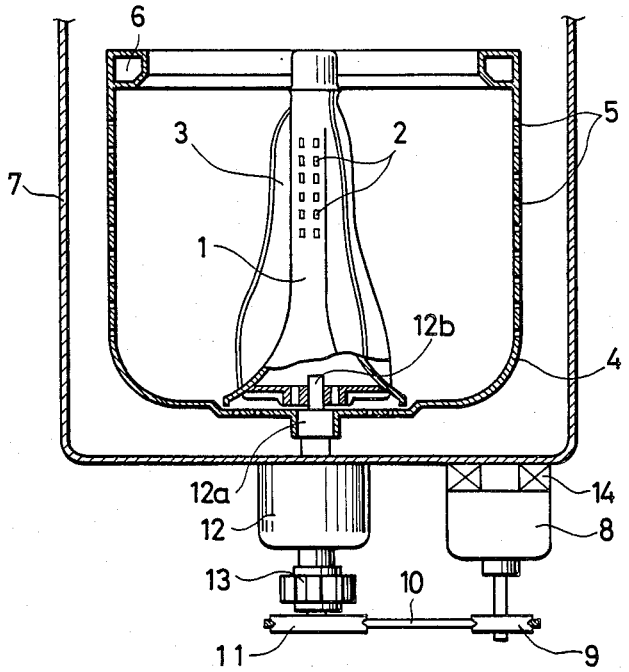
FIG. 1 is a sectional side view showing a single-tank, agitation-type washing machine which practices the method of the invention.
Figure 2:
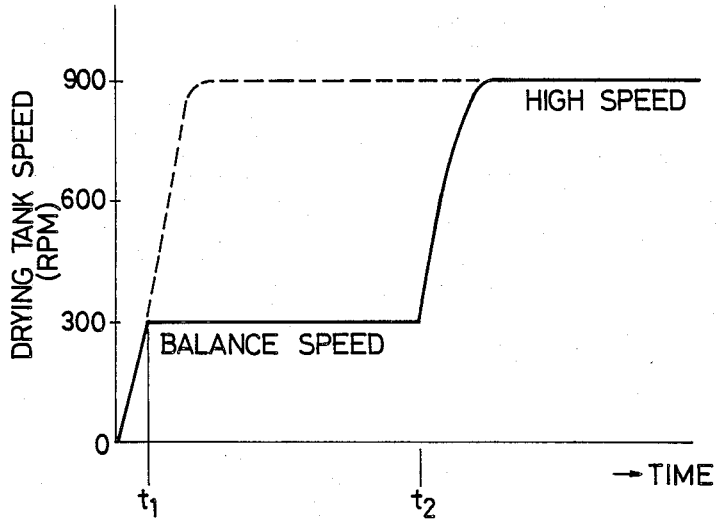
FIG. 2 is a characteristic curve diagram indicating rates of rotation of a dehydrating tank in a dehydrating method of a washing machine according to the invention.

FIG. 2 is a characteristic diagram indicating the speed of a dehydrating tank operated according to a dehydrating method of the invention. FIG. 1 is a sectional side view of the washing machine which practices the method of the invention. The construction of the washing machine is similar to that described before.

In the method of the invention, the motor 8 of the above-described washing machine is provided with a speed detector 14 for detecting the speed of rotation of the motor 8, and the output of the speed detector 14 is applied to the control device. The speed detector may be, for instance, a tachometer generator. The tachometer generator may be replaced by a device which includes a rotary plate having a detecting hole and which is secured to the shaft of the motor 8, and a U-shaped angle detector with a light-emitting section and a light-detecting section.

The washing machine further has a frequency converter 16, a control unit 15, and an AC clock circuit 17. The control unit 15 controls a drive circuit for the motor 8. The output signal of the control unit 15 is applied to the frequency converter 16. The output signal of the AC clock circuit 17 is supplied to the control unit 15. The AC clock circuit 17 is made up of a transformer 17*a*, resistors 17*b* and 17*e*, a diode 17*c*, and a transistor 17*d*.

Figure 5:
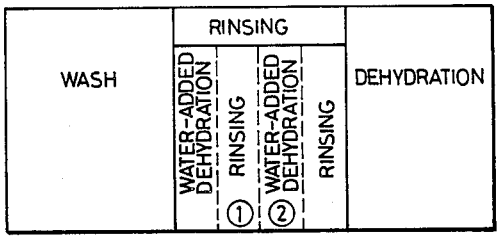
FIG. 5 is a explanatory diagram showing a washing procedure.

Washing, rinsing and dehydrating cycles are successively carried out according to a set washing procedure as shown in FIG. 5. In the washing operation, after the clothes, water and detergent are loaded into the dehydrating tank, the power switch is turned on. As a result, the motor 8 is rotated alternately in the forward direction and in the reverse direction. As controlled by the operation of a timer in the control device, the above-described washing operation is performed for a predetermined period of time, and then the wash water is discharged. Thus, the washing operation has been accomplished.

Next, in the rinse cycle, a water-added dehydration operation (water is added during spinning) and an ordinary rinsing operation (ordinary spin) are alternately carried out. The word "water-added dehydration" is intended to mean the discharging of detergent from the load while new water is being added from above.

In the water-added dehydration cycle, the spring clutch mechanism 13 is operated to rotate the shafts 12*a* and 12*b* together, and the motor 8 is rotated continuously in one direction only. When the motor 8 is energized, the dehydrating tank 4 and the agitator 1 are rotated. However, in the initial stage of the water-added dehydration cycle, the water adding operation is not yet carried out. The output of the speed detector 14 is supplied to the control unit 15. On the other hand, in the AC clock circuit 17 an input whose phase is the same as that of the power frequency applied to the motor 8 is supplied to the transformer 17*a* where the voltage of the input thus applied is reduced. The transformer output is then subjected to half-wave rectification by the diode 17*c*. The current applied to the transistor 17*d* is limited by the resistor 17*b*, and the resultant sinusoidal half wave is shaped into a rectangular wave by the transistor 17*d* and the resistor 17*e* to make it suitable as an input to the control unit 15.

Figure 4:
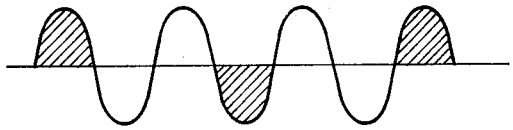
FIG. 4 is a waveform diagram showing the output waveform of a frequency converter in FIG. 3.

When the speed of rotation of the motor 8 reaches a value such that the speed of rotation of the dehydrating tank 4 is about 300 rpm (i.e., one-third of 900 rpm, which is the ordinary high speed of rotation of the dehydrating tank 4), the control unit 15 applies an output to the frequency converter 16 so that only the parts of the power waveform which are shown shaded in FIG. 4 are applied to the motor 8. The frequency of the shaded parts is one-third of the fundamental frequency (50/60 Hz). Accordingly, the speed of rotation of the motor 8 is also reduced to one-third, and the speed of rotation of the dehydrating tank 4 is decreased to one-third of the ordinary high speed of rotation thereof.

Thus, the washing in the dehydrating tank is dehydrated for a predetermined period of time while the dehydrating tank 4 is being rotated at the low speed of 300 rpm.

Figure 6:
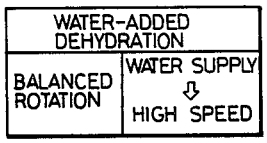
FIG. 6 is an explanatory diagram showing a water-added dehydrating operation (spin-and-rinse cycle), which forms an essential part of the washing procedure.

The low speed should be selected to be lower than the resonance point at which the dehydrating tank vibrates maximally, and therefore the low speed is not limited to 300 rpm. That is, the low speed may be set to a value in a range of about 300 rpm to 450 rpm. The operation of the dehydrating tank at the low speed will be referred to as "balanced rotation" when applicable (see FIG. 6).

During balanced rotation, the speed of rotation of the dehydrating tank is lower than the resonance point, and therefore the load has little tendency to shift to one side of the dehydrating tank. Even if the load is shifted to one side of the dehydrating tank, its position will be quickly corrected, and therefore eccentric rotation, accompanied by large amounts of noise and vibration, is scarcely caused. During balanced rotation, about 60% of the water in the clothes is removed, and the weight of the load is decreased as much.

Figure 7:
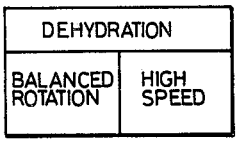
FIG. 7 is an explanatory diagram showing a dehydrating operation included in the washing procedure.

Thereafter, high speed rotation is effected. That is, the adding of water is started and the motor 8 is continuously operated. The speed of the motor 8 is increased until the speed of rotation of the dehydrating tank 4 reaches 900 rpm. During this high speed rotation, noise and vibration due to eccentric rotation are scarcely produced because the percentage of content of the water in the load has been decreased by the previous balanced rotation. Balanced rotation is carried out also in the step of final hydration as shown in FIG. 7.

Figure 3:
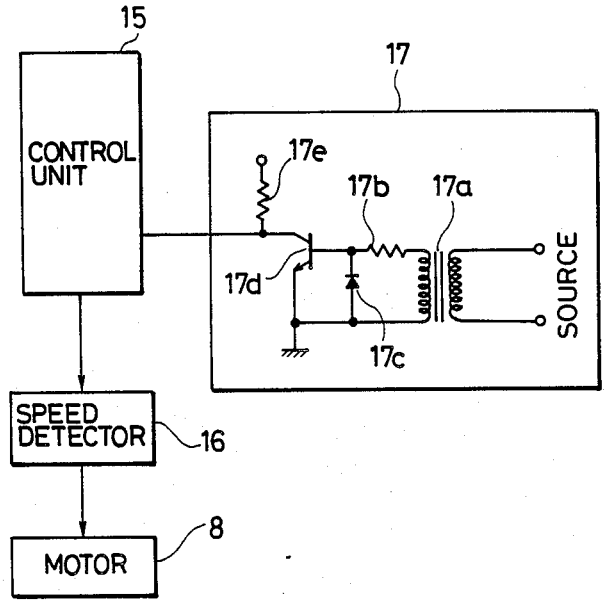
FIG. 3 is a block diagram of a dehydrating operation control section forming an essential part of the washing machine.
Figure 8:
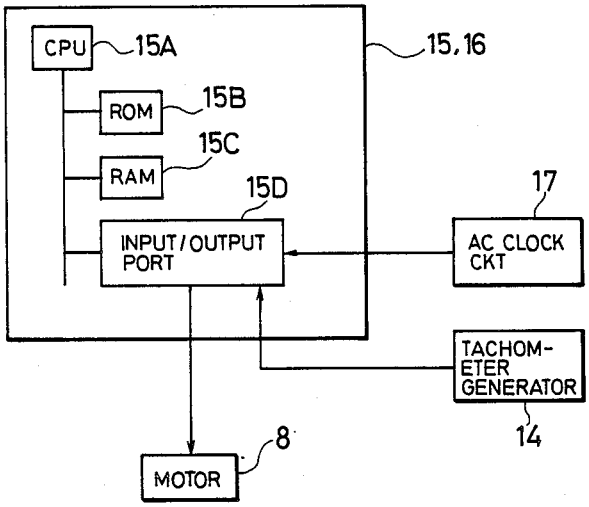
FIG. 8 is a block diagram showing a control unit and a frequency converter in FIG. 3.

Balanced rotation will be described in more detail. The control unit 15 and the frequency converter 16 in FIG. 3 include a CPU (central processing unit) 15A, a ROM (read-only memory) 15B, a RAM (random access memory) 15C, and an I/O port 15D for inputting and outputting signals, as shown in FIG. 8.

Figure 9:
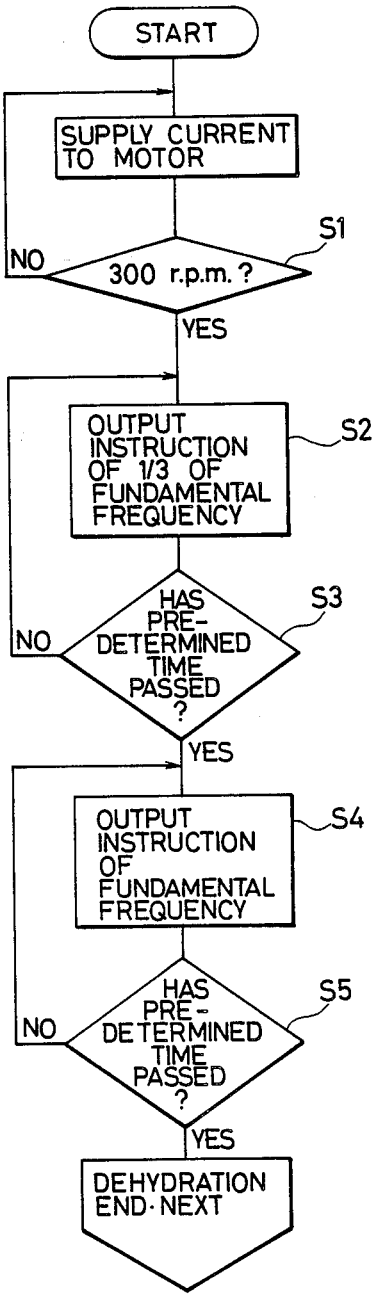
FIG. 9 is a flowchart showing the control operation of the control unit.

A program as shown in FIG. 9 is stored in the ROM 15B. During the dehydrating operation, the motor speed is controlled according to this program. When the motor 8 is energized, the CPU 15A receives the output signal of the tachometer generator 14 through the I/O port 15D and determines whether or not the speed of the motor 8 has reached the value at which the speed of rotation of the dehydrating tank is 300 rpm (S1 in FIG. 9). This operation is repeatedly carried out until an output signal is obtained which indicates that the speed of the motor 8 has reached the value at which the dehydrating tank is rotating at 300 rpm ($t_1$ in FIG. 2), and then the next step S2 is effected.

The instruction of rotation applied to the motor 8 until the step S2 is effected causes the motor to rotate at its fundamental frequency (50 or 60 Hz) as shown in FIG. 4. In the step S2, an instruction of rotation of one-third the fundamental frequency, as shown shaded in FIG. 4, in outputted. Therefore, the dehydrating tank is rotated at a low speed of 300 rpm, which is one-third the high speed of 900 rpm.

In the following step S3, it is determined whether or not the dehydrating tank has rotated at 300 rpm continuously for a predetermined period of time. When the predetermined period of time has passed ($t_2$ in FIG. 2), the next step S4 is effected.

In the step S4, the instruction of rotation at one-third that of the fundamental frequency (50/60 Hz) is changed over to the instruction of rotation of 50/60 Hz. Therefore, the motor 8 is rotated at a high speed.

The high speed rotation is followed by a dehydrating operation which is carried out for a predetermined period of time. The dehydrating operation is accomplished at the end of the predetermined period of time (S5 in FIG. 9).

The dehydrating operation including balanced rotation is carried out as described above.

In the above-described embodiment, the motor 8 is started in the ordinary manner, and the speed of rotation of the motor 8 detected so that, when the speed of rotation reaches about 300 to 450 rpm, the dehydrating tank 4 is rotated at the low speed. However, the following method may be employed instead.

At the start of the washing operation, the operating section applies a input signal to the control unit 15 so that the dehydrating tank 4 is rotated, for instance, at 300 rpm for a predetermined period of time in the initial stage of the water-added dehydration cycle, namely, a low speed rotation instruction is applied at the start of rotation of the dehydrating tank. That is, similar to the above-described first embodiment, the washing operation is carried out, and thereafter water-added dehydration is effected. Thereupon, the control unit 15 provides an output so that the speed of rotation of the dehydrating tank 4 is set to 300 rpm (in response to the output of the frequency converter 16) from the start of rotation.

While an embodiment of the invention has been described with reference to a fully automatic, agitation-type washing machine, the technical concept thereof is applicable to all washing machines which have dehydrating tanks such as double-tank type washing machines and pulser-operated (vortex type) washing machines.

The operation of a second embodiment of the invention will be described.

FIG. 2 shows a standard washing procedure for a washing machine of the second embodiment. In the washing operation, the clothes, water and detergent are placed in the dehydrating tank 4 and then the power switch is turned on. As a result, the motor 8 is rotated alternately in the forward direction and in the reverse direction, and accordingly the agitator 1 is also rocked. Controlled by a timer in the control device, the above-described operation is continued for a predetermined period of time, and then the water is discharged. Thus, the washing operation has been accomplished, and the rinsing operation is effected.

In the rinsing operation, a water-added dehydration and an ordinary rinsing operation are alternately carried out. In the water-added dehydration cycle, the spring clutch mechanism 13 is operated to rotate the shaft **12*b* together with the shaft 12*a* and the motor 8 is rotated in one direction only. When the motor 8 is energized, the dehydrating tank 4 and the agitator 1** are rotated. However, in the initial stage cf the water-added dehydration cycle, the water adding operation is not carried out.

Figure 10:
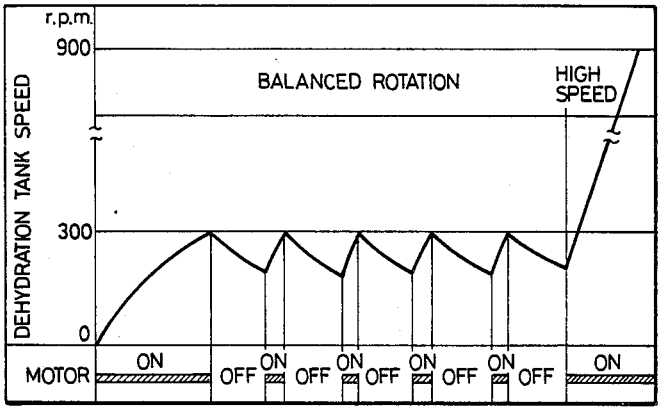
FIG. 10 is an explanatory diagram for a description of a dehydrating method for a washing machine in accordance with a second embodiment of the invention.
Figure 11:
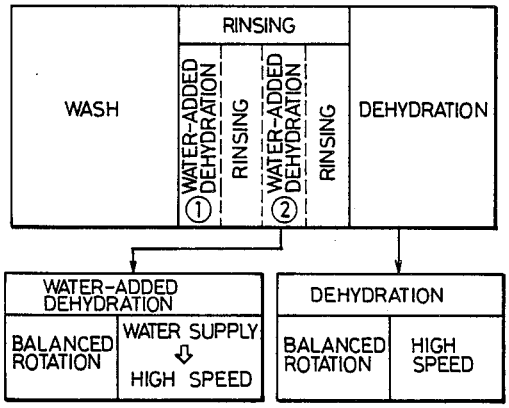
FIG. 11 is an explanatory diagram showing an ordinary washing procedure.

As shown in FIG. 10, when the speed of the motor 8 increases to rotate the dehydrating tank 4 at 300 rpm, the control device provides an output to stop the motor 8 for a short period of time. In succession, the motor 8 is started again, and the speed of the motor 8 is increased until the speed of the dehydrating tank reaches 300 rpm. This operation is repeated about five times.

The speed of 300 rpm is the upper limit value because it is lower than the resonance point at which the dehydrating tank 4 vibrates maximally, as described before. The intermittent operation of the dehydrating tank at the low speed of rotation is referred to as "balanced rotation" in the second embodiment also.

During balanced rotation, the speed of rotation of the dehydrating tank is lower than the resonance point, and therefore the load does not have a strong tendency to shift to one side in the dehydrating tank. Even if the load does shift to one side of the dehydrating tank, the position is quickly corrected, and therefore eccentric rotation accompanied by large amounts of noise and vibration is scarcely caused. During balanced rotation, about 30% of the water in the clothes is removed, and the load on the motor is decreased as much.

Thereafter, high speed rotation is effected. That is, the adding of water is started again, and the motor 8 is continuously operated until the speed of the dehydrating tank 4 reaches 900 rpm. During high speed rotation, noise and vibration due to eccentric rotation are scarcely produced because the quantity of water in the clothes has been partially decreased during balanced rotation.

After the rinsing operation, the final operation, namely, a dehydrating operation, is carried out. As in the above-described case, balanced rotation is carried out in the initial stage of the dehydrating operation Balanced rotation will be described in more detail. Balanced rotation is carried out by the same circuit as that shown in FIG. 8; however, it should be noted that a program as shown in FIG. 12 is stored in the ROM 15B

Figure 12:
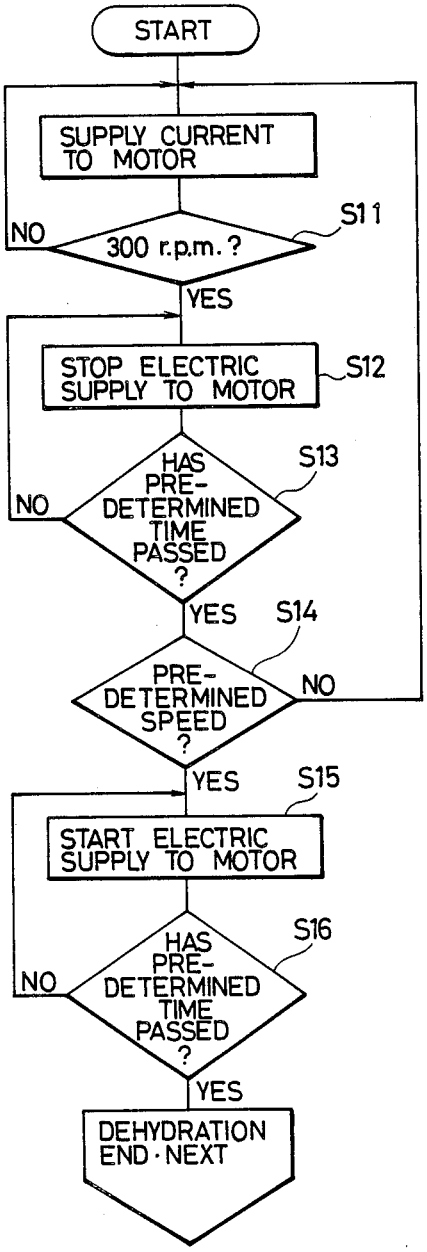
FIG. 12 is a flow chart showing the control operation of the control unit in the second embodiment.

As indicated in FIG. 12, upon energization of the motor 8, the CPU 15A receives the output signal of the tachometer generator 14 through the I/O port 15D and then determines whether or not the signal represents the fact that the speed of rotation of the dehydrating tank has reached 300 rpm (Step S11 in FIG. 12). If the speed of rotation represented by the signal is smaller than 300 rpm, the determination is carried out again. When it is detected that the signal indicates that the speed of rotation of the dehydrating tank has reached 300 rpm, the next step S12 is effected.

In the step S12, the energization of the motor 8 is stopped for a predetermined short period of time, as a result of which the speed of rotation of the motor 8 is temporarily decreased as shown in FIG. 10.

In the subsequent step S13, it is detected whether or not the deenergization of the motor 8 has been performed for the predetermined short period of time. When the predetermined short period of time has passed, the next step S14 is effected.

In the step S14, it is detected how many times the energization of the motor 8 has been interrupted. That is, the energization and deenergization of the motor is repeated a predetermined number of times, and then the next step S15 is carried out.

In the step S15, the motor 8 is rotated at a high speed so that the dehydrating tank is rotated at 900 rpm as shown in FIG. 10.

In the subsequent step S16, the period of time for which the dehydrating tank is rotated at the high speed is determined. When the period of time thus detected reaches a predetermined value, high speed rotation is stopped. Thus, the dehydrating operation has been accomplished.

According to the above-described program, the dehydrating operation including balanced rotation is carried out.

The rotation of the dehydrating tank 4 may be controlled merely by controlling the period of energization of the motor 8. However, since the force of rotation due to inertia depends on the size of the washing load, in this energization period control method it is impossible to estimate ahead of time the time of application of the force of rotation. Therefore, when the motor 8 is stopped, the speed of rotation of the motor 8 is decreased temporarily; however, it increases gradually because the motor is started again. Accordingly, the speed of rotation of the dehydrating tank is increased as the on-off operation of the motor is repeated. Thus, it is difficult to maintain the speed of rotation of the dehydrating tank lower than the resonance point.

While the second embodiment has been described with reference to a fully automatic, agitation-type washing machine, the technical concept is applicable to all washing machines which have dehydrating tanks such as double-tank type washing machines and pulsator-operated washing machines As is apparent from the above description, in the inventive dehydrating method for washing machines described with reference to the second embodiment of the invention, it is unnecessary to add special mechanisms or electrical components to the washing machine, and the method ensures a low amount of vibration and low amount of noise. Furthermore, use of the method prevents the difficulty of the dehydrating tank being stopped during dehydration A third embodiment of the invention concerning a low speed dehydrating operation will now be described.

Figure 13:
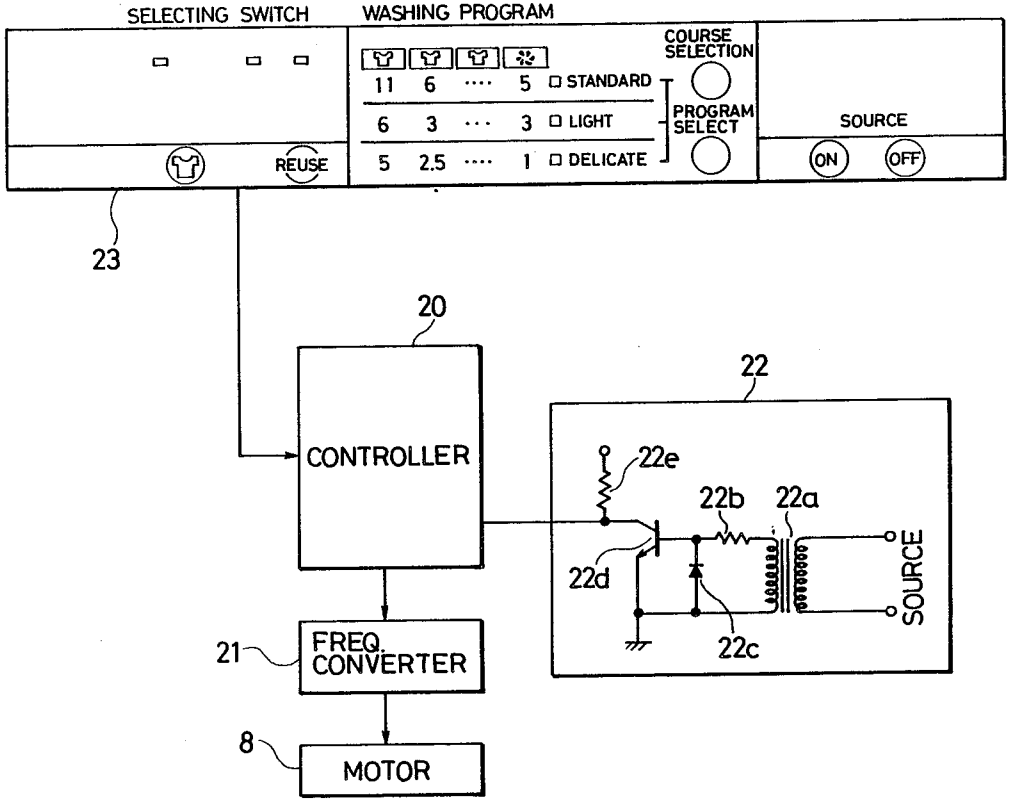
FIG. 13 is a block diagram of an operation control mechanism employed in a dehydrating method for a washing machine in accordance with a third embodiment of the invention.

In FIG. 13, reference numeral 20 designates a control unit, which is an essential component of the operation control device and which uses a microcomputer or the like; 21, a frequency converter; 22, an AC clock circuit including a transformer 22*a*, resistors 22*b* and 22*e* a diode 22*c*, and a transistor 22*d*; and 23, an operating section for setting the speed of rotation and a period of rotation for the dehydrating tank 4.

Output signals of the operating section 20 and the AC clock circuit 22 are supplied to the control unit 20, the output signal of which is applied through the frequency converter 21 to the motor 8.

A preferred method of controlling the dehydrating operation with the above-described operation control device will be described. Before the start of a washing operation, a speed of rotation and a period of rotation suitable for the material of the load are set, for instance, to 300 rpm (one-third of the ordinary high speed of rotation of 900 rpm) using the operating section 23, specifically, by depressing a "DELICATE" switch of the washing program section. Similar to the case of conventional washing machine, the timer of the control device is then operated to rotate the motor 8 alternately in the forward direction and in the reverse direction for a predetermined period of time, thereby to rock the agitator to perform the washing operation. Thereafter, the water is discharged, and then a dehydrating operation is carried out.

In the dehydrating operation, the spring clutch mechanism 13 is operated to rotate the shafts 12*a* and 12*b* together so that the motor 8 is rotated in one direction only. The rotation of the motor 8 is transmitted through the pulley 9, the V-belt 10, the pulley 11 and the rotation transmitting section 12 to the dehydrating tank 4. As a result, centrifugal force is applied to the load in the dehydrating tank, and the clothes are therefore dehydrated.

In the dehydrating operation, the speed of 300 rpm of the dehydrating tank set by the operating section 23 is instructed to the control unit 20, and, on the other hand, an input whose phase is the same as that of the power applied to the motor 8 is supplied to the transformer 22*a*. The voltage of the input is reduced by the transformer 22*a*, and the transformer output is subjected to half-wave rectification by the diode 22*c*. The current applied to the transistor 22*d* is limited by the resistor 22*b*, and the transistor 22*d* and the resistor 22*e* form a sinusoidal rectangular half-wave signal which is suitable as an input to the control unit 20. Thus, the control unit 20 receives the two inputs and applies outputs to the frequency converter 21. In this case, only the parts of the power signal shown shaded in FIG. 4 are applied to the motor 8. The frequency of the shaded parts is one-third the fundamental frequency (50/60 Hz). Accordingly, the speed of rotation of the motor 8 (which is an induction motor) is also reduced to one-third, and the speed of rotation of the dehydrating tank 4 is decreased to one-third of its ordinary high speed of rotation. Thus, the clothes in the dehydrating tank 4 are dehydrated in the dehydrating tank 4 which is rotated at the low speed.

Figure 14:
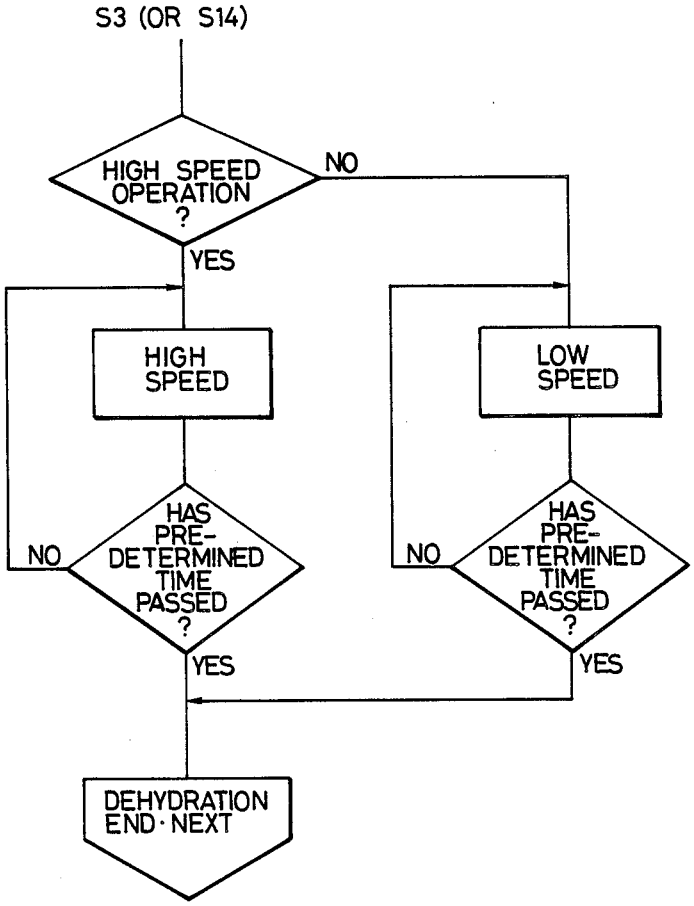
FIG. 14 is a flowchart showing the control operation of the control unit in the third embodiment.

This low-speed dehydration operation will be described in more detail. The dehydration operation is also controlled by the same circuit as that shown in FIG. 8; however, it should be noted that the program stored in the ROM 15A is different. That is, the program is the same as that shown in FIG. 9 up to the step S3 (or that shown in FIG. 12 up to the Step S14), and the following steps are as indicated in FIG. 14.

After the step S3 (or S14) of ending balanced rotation, the washing program selected by the operation section 23 is confirmed so as to determine whether or not high-speed dehydration is selected (Step S21). If high-speed dehydration has been selected, the motor is rotated at the high speed (Step S22). If high-speed dehydration has not been selected, then the motor is rotated at the low speed (Step S23). In both high-speed rotation and low-speed rotation, the period of rotation is confirmed and the rotation is continued for the predetermined period of time.

In the above-described embodiment, the speed of rotation of the dehydrating tank 4 is one-third of the ordinary high speed of rotation; however, the speed of rotation is not limited thereto or thereby. That is, any speed of rotation lower than the high speed of rotation, such as a speed half the high speed of rotation, can be used. It has been found through experiments that a speed of rotation which is on the order of one-third to one-half the high speed of rotation is preferable for delicate fabrics such as wool.

As is apparent from the above description, in the dehydrating method for washing machines of the third embodiment of the invention, the dehydrating tank is rotated not only at the high speed of rotation but also at a low speed of rotation one-third to one-half the high speed of rotation. Therefore, a speed of rotation, and hence a centrifugal force, suitable for the material of the clothes being washed is obtained. Accordingly, even a garmet of made of a delicate fabric such as wool will never be damaged, deformed or creased during the dehydrating operation.

We claim:

1. A method of dehydrating a load of cloths in a tank of a washing machine which comprises the steps of:

(a) automatically detecting that the operation of said washing machine is in an initial stage of a dehydrating operation;

(b) in said initial stage of said dehydrating operation, causing said tank to be rotated at a predetermined low speed for a predetermined period of time to partially remove water from said load; and (c) rotating said tank at high speed when said predetermined period has passed.

2. The method as claimed in claim 1, further comprising the step of providing frequency conversion means responsive to a control unit for controlling the speed of a motor, and in which said step of causing said tank to be rotated at said predetermined low speed comprises:

(i) detecting a speed of rotation of said tank;

(ii) detecting whether or not said speed of rotation thus detected has reached said predetermined low speed of rotation;

(iii) upon detection of the fact that said tank is rotating at said predetermined low speed, maintaining said predetermined low speed for said predetermined period of time; and further including the step of changing over from said low speed to said high speed in response to the output of said frequency conversion means.

3. The method as claimed in claim 2, further including the steps of generating a rectangular wave clocking signal using a clock circuit and, in response to said clocking signal and the detected speed of rotation of said tank, selecting predetermined half-wave portions of a sinusoidal power waveform to be applied to said motor by said frequency conversion means, thereby affecting said speed of rotation of said tank.

4. The method as claimed in claim 1, further comprising the step of providing frequency conversion means responsive to a control unit for controlling the speed of a motor, and in which said step of causing said tank to be rotated at said predetermined low speed comprises:

(i) applying a predetermined low speed rotation instruction to said motor which rotates said tank;

(ii) outputting said predetermined low speed rotation instruction continuously for said predetermined period of time; and further including the step of changing over from said low speed to said high speed in response to the output of said frequency conversion means.

5. The method as claimed in claim 14, further including the steps of generating a rectangular wave clocking signal using a clock circuit and, in response to said clocking signal and the detected speed of rotation of said tank, selecting predetermined half-wave portions of a sinusoidal power waveform to be applied to said motor by said frequency conversion means, thereby affecting said speed of rotation of said tank.

6. The method as claimed in claim 1, in which in said step of rotating said tank at low speed, the speed of rotation thereof is one-third to one-half that in said step of rotating said tank at said high speed.

7. A method of dehydrating a load of clothes in a tank of a washing machine which comprises the steps of:

(a) automatically detecting whether said washing machine is performing an initial stage of a dehydration operation;

(b) determining whether a dehydrating operation being carried out is a first dehydrating operation or a second dehydrating operation;

(c) in said initial stage of said dehydrating operation, causing said tank to be rotated at a predetermined low speed for a predetermined period of time to partially remove water from said load; and (d) rotating said tank at high speed when said predetermined period has passed, and adding water to said load when it is determined that said second dehydrating operation is being carried out.

* * * * *